US008408685B2

(12) United States Patent
Delueg

(10) Patent No.: US 8,408,685 B2
(45) **Date of Patent: *Apr. 2, 2013**

(54) INK SUPPLY SYSTEM AND METHOD OF OPERATING AN INK SUPPLY SYSTEM OF AN INKJET PRINTER

(75) Inventor: Verner Delueg, Brixen (IT)

(73) Assignee: Durst Phototechnik Digital Technology GmbH, Lienz (AT)

( * ) Notice: Subject to any disclaimer, the term of this patent is extended or adjusted under 35 U.S.C. 154(b) by 435 days.

This patent is subject to a terminal disclaimer.

(21) Appl. No.: 12/590,007

(22) Filed: Oct. 30, 2009

(65) Prior Publication Data

US 2010/0110155 A1 May 6, 2010

(30) Foreign Application Priority Data

Oct. 31, 2008 (AT) ..... A 1707/2008

(51) Int. Cl.
*B41J 2/175* (2006.01)

(52) U.S. Cl. ..... 347/85; 347/89

(58) Field of Classification Search ..... 347/7, 84, 347/85, 89, 92

See application file for complete search history.

(56) References Cited

U.S. PATENT DOCUMENTS 4,929,963 A 5/1990 Balazar
5,801,736 A * 9/1998 Ikkatai et al. ..... 347/86
6,007,193 A 12/1999 Kashimura et al.
6,231,174 B1 5/2001 Haigo
6,371,607 B2 4/2002 Wouters et al.

(Continued)

FOREIGN PATENT DOCUMENTS

| | | |
|---|---|---|
| DE | 600 22 690 | 6/2006 |
| EP | 0 714 778 | 6/1996 |
| EP | 1 361 066 | 11/2003 |
| EP | 1 831 025 | 9/2007 |
| WO | WO 2008/108245 | 9/2008 |

OTHER PUBLICATIONS

Austrian Office Action dated Jun. 3, 2009 in Austrian Application No. A 1275/2008 along with an English translation of the relevant parts.

*Primary Examiner* — Anh T. N. Vo
(74) *Attorney, Agent, or Firm* — Collard & Roe, P.C.

(57) ABSTRACT

The invention relates to an ink supply system (2) for an inkjet printer (1) as well as a method of operating the ink supply system and an inkjet printer. The inkjet printer comprises a print head arrangement (6) incorporating several print heads (7) with one or more nozzles (8) for at least one color. The print heads (7) are connected via connecting lines (19) to a supply tank (187) connected via a filling line to an intermediate tank (12) with a conveyor means (16) and a filter arrangement (18) connected in between, and connected separately in each case via second connecting lines (21) to a common return tank (22). Means (32) are provided by means of which a pressure difference can be maintained in the supply tank (17) and/or in the return tank (22) as and when necessary to control a flow of ink from the supply tank (17) via the flow passages (20) of the print heads (7) connected in parallel to the return tank (22). The return tank (22) is directly connected to the supply tank (17) via a return line (24), optionally with a conveyor means (25) connected in between.

25 Claims, 8 Drawing Sheets

U.S. PATENT DOCUMENTS

| | | | | |
|---|---|---|---|---|
| 7,841,708 | B2 * | 11/2010 | Morgan et al. | 347/85 |
| 8,128,196 | B2 * | 3/2012 | Garbacz et al. | 347/35 |
| 2008/0024553 | A1 * | 1/2008 | Morgan et al. | 347/42 |
| 2008/0273063 | A1 | 11/2008 | Wouters et al. | |
| 2008/0297577 | A1 | 12/2008 | Wouters et al. | |
| 2009/0040249 | A1 | 2/2009 | Wouters et al. | |
| 2010/0039460 | A1 * | 2/2010 | Delueg | 347/7 |

* cited by examiner

INK SUPPLY SYSTEM AND METHOD OF OPERATING AN INK SUPPLY SYSTEM OF AN INKJET PRINTER

The invention relates to an ink supply system, as well as a method of cleaning such an ink supply system, and an inkjet printer.

Ink supply systems for inkjet printers are already known, which have a print head arrangement with at least one print head. As specified in EP 1 831 025 B1, such a system comprises a supply tank containing a supply of ink for an inkjet print head and a return tank containing a surplus of ink not used by the inkjet head. An intermediate container containing a larger supply of ink is connected to the supply tank by means of a line with an interconnected filter arrangement. Depending on the level of ink in the supply tank, ink is conveyed from the intermediate container into the supply tank by a conveyor means. From the supply tank, the ink is fed via an inlet line of several first connecting lines of flow passages of several print heads, and second connecting lines link these flow passages via other connecting lines to the return tank, which is connected to the intermediate container via other connecting lines with an interconnected filter arrangement and a conveyor means. During the printing operation, a pressure difference is built up in the interior between the interior of the supply tank and the interior of the return tank by a means, for example a vacuum generator, so that the ink is conveyed from the supply tank through the print heads to the return tank due to this difference in pressure. In addition to supplying ink to the print heads, another known option is to rinse the print head of such an inkjet printing system in order to remove dirt. To this end, a positive pressure is applied to both the supply tank and the return tank, which ensures that the ink contained in both tanks is rinsed out through the print head. The disadvantage of this system is that in addition to providing means such as a vacuum generator, it is also necessary to provide a pressure generator.

The underlying objective of the invention is to propose an ink supply system in which the ink circuit and the process of cleaning it can be made simpler. Another, independent, objective of the invention is to improve an inkjet printer so that it can be used with inkjet printers of a universally configurable design and can be readily adapted to a plurality of different media formats and a plurality of different process media.

The objective of the invention is achieved on the one hand by an ink supply system in accordance with the invention. The advantage of this ink supply system is that during printing operation, the pressure in the print head can be finely controlled and kept constant. Furthermore, it is possible to establish a direct ink circulation between the return tank and supply tank.

In another preferred embodiment, the ink can also be directed through the circuit from the return tank to the supply tank and through the print heads, and the ink is only fed through the print heads in the opposite direction intermittently by the conveyor device during intermediate cleaning cycles either during a stoppage or whilst the printing operation continues, which significantly reduces and even totally prevents dirt from occurring and sticking to the pipes between these two tanks and in the print heads, even if supplying a plurality of print heads connected in parallel.

Also of advantage is another embodiment because ink does not have to be supplied from the intermediate container to the internal ink circuit other than intermittently, depending on ink consumption.

An advantage gained by another embodiment is that the ink, possibly containing residues caused by sedimentation or agglomeration, can be fed off to the intermediate tank via a separate line, which means that the filling line for additional ink needed in the internal circuit between the supply and return tanks is not contaminated by ink containing dirt as it is fed away.

Another embodiment is also of advantage because the filling line for the ink can be used as a return line to convey all the ink back into the intermediate tank during cleaning cycle of the print heads and supply and return tanks. Another advantage is the fact that it is possible to make do with only a single line providing a connection between the external intermediate tank with a large volume and the supply and return tanks, thereby reducing the masses which have to be moved, especially in the case of so-called scan-print heads where the print head is moved transversely to the feed direction of the substrate to be printed. If using a displaceable, flexible hose or hose pack between the scanning print head and the stationary intermediate tank, load placed on the print head due to vibrations can also be reduced whilst nevertheless ensuring a long service life of the print heads.

Other advantageous embodiments of the ink supply system are discussed below.

The objective is also achieved independently on the basis of a method of cleaning an ink supply system in accordance with the invention. The advantage of this approach is that the ink circulation paths can be kept short, which ensures that the ink temperature can be kept as constant as possible using a relatively small amount of energy, in addition to which the constant movement of the ink also reduces or prevents the build-up of sedimentation or agglomerations. This means that only short, internal cleaning cycles can be achieved over a longer period of time without disrupting the printing operation. Furthermore, the printing speed of scanning print heads can advantageously be increased because the moved masses and the number of supply lines needed to supply the print heads with ink can be reduced, thereby reducing the effect of vibrations of the scanning print head.

Other advantageous features relating to the method of operating the ink supply system are discussed below.

The objective of the invention is also independently achieved on the basis of an inkjet printer in accordance with the invention. A design is used whereby several print heads are disposed in a print head module and as a result of this design in particular, it is possible to provide print heads of differing designs distributed across the printing range width. For example, it would be conceivable to provide print heads with a different resolution or different printing ink. Furthermore, the print heads can be rapidly adapted to the required conditions in order to accommodate different materials. The fact that each print head module is provided with a releasable coupling mechanism ensures that every print head module can be fitted in any possible position of the printing range width, where it can be reliably supplied with operating means or control signals and image data. A releasable coupling mechanism means that a defective print head module can be rapidly replaced in the event of a fault without having to undertake complex servicing of the print head arrangement.

Also of advantage is another embodiment, because standardized elements can be used to manufacture the complex line connections between the individual modules of such an inkjet printer, thereby keeping the construction and maintenance as well as the task or eliminating faults simple.

As a result of this advantageous design, the system of connecting lines can also be adapted to the requirements of the inkjet printer to be set up. In particular, if using this advantageous design, it is not necessary for the supply of operating means or the activation systems to be disposed in the immediate vicinity of the print head arrangement, and these can be optionally positioned to suit the design.

Another advantageous embodiment is one in which the nozzle rows of the print head arrangement have a printing range width as measured perpendicular to the feed direction constituting the total printing range width, which extends at least across a width of the printing medium to be printed. As a result, the range can be set to any width if the print head arrangement comprises several print head modules.

With a view to obtaining a modular design and ensuring that the print head modules can be used universally as far as possible, it is of particular practical advantage to opt for a design in which the interfaces in the coupling mechanism or its coupling elements of each print head module are identical. This design ensures that the print head modules are interchangeable and the print head arrangement can be set up on the basis of a plurality of differently designed print head modules. In particular, the print head modules may be designed differently for example, so that they each have a different resolution capacity, are monochrome or multi-colored or have a redundant nozzle row. The modular connecting line system is disposed so that it reaches the appropriate printing range width and the print head modules are connected by means of their coupling mechanisms. This enables the print head arrangement to be freely configured to any design.

It is also of particularly crucial importance for the coupling mechanism or a coupling element of it to be disposed in a fixed position relative to a support surface of the printing table in the case of each print head module. The support surface of the printing table is preferably the support surface on which the medium to be printed lies, and the printing nozzles, in particular the nozzle orifices, are disposed at a defined distance from the support surface. It is necessary to conform exactly to this distance in order to obtain a corresponding printed image. The fact that the coupling mechanism is positioned relative to this support surface ensures that every print head module can be connected to the connecting line system by means of the coupling mechanism regardless of its specific design. This design is also of crucial importance to the design of the modular inkjet printer proposed by the invention.

Likewise with a view to obtaining a module-based design of the inkjet printer proposed by the invention, it is of vital importance to provide a housing device for the coupling mechanism or a coupling element in every connecting line module in a defined position relative to a support surface of the printing table. This design ensures that the print head module can be fitted to the connecting line system without the need for additional modification or adjustments. In particular, this design ensures that, for all print head modules, the distance between the ejection nozzle and the medium to be printed can be maintained exactly. Specifically with a view to obtaining a modular construction and keeping the design of the print head arrangement as simple as possible, it is of particular advantage if the mechanical and geometric requirements needed to achieve a high-quality printed image are fixedly pre-set so that only a minor adjustment is needed to set up a print head arrangement.

Since there is the option of being able to use differently designed print head modules in the print head arrangement, it is of advantage if the coupling mechanism or a coupling element of the print head module is provided with an identification feature. This identification feature preferably has a unique or characteristic code of the print head module. When the print head module is connected to the connecting line system, the identification feature is read and the characteristic information about the print head module is transmitted to a primary control unit, for example. Accordingly, it is possible to ascertain unambiguously at any time which specific print head module is disposed in which relative position of the print head arrangement. Particularly if the print head modules incorporate different designs, the claimed design offers a very specific advantage in that the control data supplied to the print head modules is adapted to the corresponding options of the print head modules in terms of printing technology. However, the identification features could be designed to effect only an adaptive transmission of printing parameters. For example, a nozzle problem or problems in the supply of process media could be reported back to the primary control unit.

In another advantageous embodiment, the identification feature is designed to provide a contactless evaluation of at least one memorized characteristic. The advantage of a contactless evaluation, for example by means of RFID, is that the identification feature can be made to a particularly compact and space-saving design but will still enable characteristics to be reliably transmitted.

The advantage of using an evaluating device disposed in the connecting line module in the position opposite the coupling mechanism is that stored characteristics can be read out for every print head module disposed in the print head arrangement. Another advantage of this design is that a continuous monitoring system can be set up by reading out the characteristics.

Another advantageous embodiment is one in which the print head arrangement has an evaluating device. It may be that it is not necessary to monitor identification features continuously and it is possible for the printing data system or allocation of print head modules to be set up in the print head arrangement when the print head arrangement is assembled. The individual print head modules can therefore be identified by the evaluating device and thus disposed sequentially in the next free position of the connecting line system.

In the case of another embodiment, the coupling mechanism or its associated coupling elements have an automatically acting locking and/or releasing mechanism. The advantage of this design is that no additional complex retaining mechanisms or connecting means are needed in order to fit the print head modules to the connecting line system. The print head modules used to make up the print head arrangement can be connected to the connecting line system easily, rapidly and without any complications. The claimed design of the coupling mechanism also ensures that the process media as well as the power and data cables can be reliably coupled without the need for additional equipment.

Of particular advantage is a design where the coupling mechanism has several coupling elements in which functionally co-operating interfaces are disposed in a defined arrangement. To obtain the best possible universal and modular design, it is of particular advantage if the coupling mechanism is designed so that a fixedly predefined portion is provided for the predominant number of all possible interfaces. Disposing functionally co-operating interfaces in defined sections significantly simplifies the design of the connecting line system. In particular, the connecting means can be readily adapted to the interface to be set up. Another advantage of this arrangement in sections is that additional requirements for specific functionally co-operating interfaces can be efficiently defined in terms of spatial requirements. For example, a specific access protection may be required for specific interfaces.

With a view to obtaining a reliable connection of the print head module to the connecting line system, it is of advantage if the interfaces are designed to provide fluid-tight and gas-tight connections and disconnections. The connecting line system may be designed to enable a print head module to be connected in fixedly predefined positions. In particular, however, it is also possible to leave positions free if they are not needed for example, or if a print head module extends across several connection positions. This ensures in particular that unused connection positions are reliably uncoupled and there can be no inadvertent leakage of process media.

Based on another advantageous embodiment, the interfaces are designed to provide a fault-free electrical connection and disconnection. To guarantee reliable operation and facilitate maintenance, it is of particular advantage if the supply of control data and electrical power to the print head modules is set up so that connections and disconnections do not produce disruptive electrical effects.

In the case of another embodiment, the connecting line system is made up of a plurality of separate connecting lines grouped in a connecting line string. The advantage of this is that the connecting line string can be disposed particularly compactly in the connecting line module. In particular, a connecting line string based on the claimed design can be efficiently protected from mechanical effects such as usually occur in an inkjet printer, thereby reducing susceptibility to faults and increasing service life.

A connecting line module comprising at least two functionally identical coupling mechanisms offers an advantage in that it lends itself to a connecting line system based on virtually any topology. It is of particular advantage if the connecting line system can be adapted to conditions at the site where the inkjet printer is to be installed. The connecting line modules ensure that the process media, control data and operating power can also be reliably conveyed to the print head arrangement across a longer distance and thus on to the print heads.

According to the claim, the connecting line module is designed to provide a coupling for a module from the group comprising power supply module, process media supply module, control module and monitoring module without having to make a specific choice. The modular design advantageously enables the respective module to be fitted in the position of the connecting line system which is the best for the medium to be connected. For example, the ink supply module may be disposed in the immediate vicinity of the print head arrangement and other process media or the electrical power can be fed into the connecting line system from a point farther away.

In another embodiment, the medium positioning device comprises several table modules (133) which can be connected to one another by means of releasable coupling mechanisms (107) of the same type disposed in the same manner to set up a printing table (103). In the case of a modular inkjet printer, however, it is a significant advantage if the medium positioning device is able to process a plurality of different printing media. It is of particular advantage if the medium positioning device can be rapidly and flexibly adapted to changing conditions of the printing medium. For example, it is possible to change the printing width at any time by adding another table module to the printing table.

A simple, modular way of assembling new inkjet printers or rearranging and adapting them to different requirements can be achieved if at least one medium transport module is provided on the table modules which is connected to the table modules by means of identically arranged and releasable coupling mechanisms.

The work involved in assembly can also be reduced and economic production of such inkjet printers based on a large number of prefabricated mass-produced parts if the coupling mechanisms of the table modules and the medium transport module are connected via connecting line modules to the table or medium transport modules.

Other savings on manufacturing and re-fitting such inkjet printers can be made if the table modules and medium transport modules are based on the same design and can be connected to one another and secured by means of releasable coupling mechanisms or if each medium transport module has a medium transport device which can be connected to the medium transport module and/or to the table module and/or to the control device via connecting line modules.

During printing, especially high-resolution, high-speed printing, some of the print heads can become very hot, which has a negative effect on the print quality. It is therefore of advantage to provide a temperature sensor in the print head module because this enables the temperature of the print heads or of the print head to be continuously detected.

In one particularly advantageous embodiment, a printing data processing device is provided in the print head module. The control data for activating the printing nozzles of the print head arrangement usually requires a very large volume of data. The advantage of one claimed design is that the data to be printed is prepared directly at the print head module, which means that a significantly smaller volume of data has to be transmitted to the print head module. Also of advantage is the fact that the data processing device is configured exactly for the respective print head module, which means that the exact printing parameters are therefore available and processing of the printed image can be optionally adapted to the design of the printing nozzles. The sender of the printing order merely has to set up a few printing parameters because this task is taken over by the claimed printing data processing device.

Due to the modular design of the inkjet printer proposed by the invention, there is no point in centrally monitoring the operating status. Since a different number of modules are connected to one another to set up the inkjet printer and each module may be set up to store specific operating parameters, another embodiment is of particular advantage in which a diagnosis module is provided in at least one module selected from the group comprising a print head module, connecting line module, power supply module, process media supply module, control module and monitoring module. Such a module is then able to monitor the main operating parameters continuously and transmit any defects or faults which occur to a primary controller. In any event, it is of advantage if a claimed diagnosis module is adapted exactly to the module to be monitored and only reports that are relevant to operation, in particular fault reports, are transmitted to a primary controller without it having to be aware of all possible fault reports of all possible modules. A claimed diagnosis module issues the reports in such a way that they can be interpreted by the controller.

In the case of a modular inkjet printer, it is of particular advantage if the control module is provided in the form of a decentralized controller, especially if a control cell of this decentralized controller is provided for a predominant number of the modules. In a manner known in connection with decentralized control systems, each control cell assumes a locally limited control function and it is only the control tasks that are relevant to all the modules that are run by a head station, for example.

The invention will be described in more detail with reference to examples of embodiments illustrated in the appended drawings. Of these:

Figure 1:
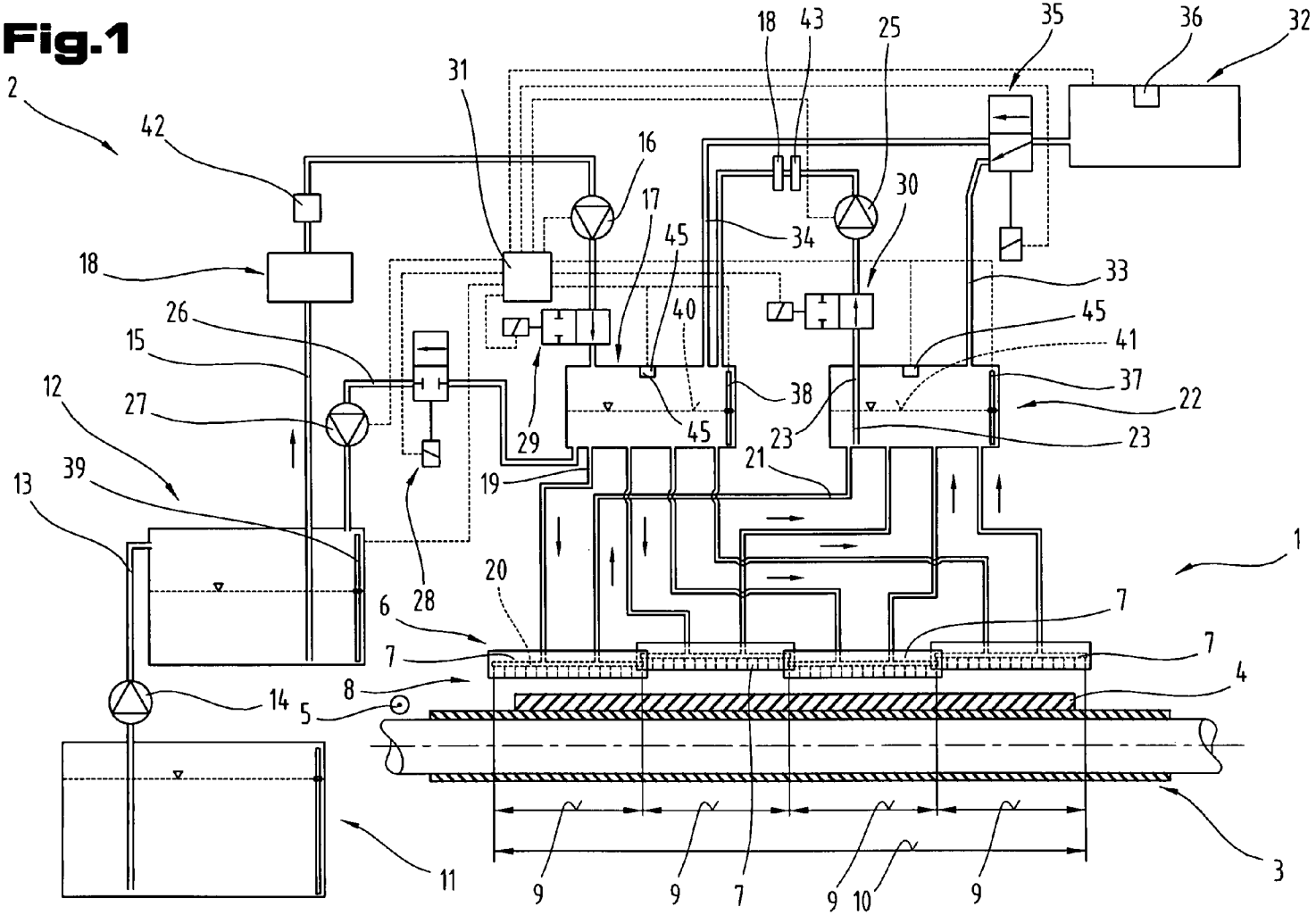
FIG. 1 is a highly simplified, schematic diagram of an inkjet printer with an ink supply system in the "printing mode" operating status.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

FIG. 1 is a highly simplified, schematic diagram illustrating part of an inkjet printer 1 with an ink supply system 2. To maintain better clarity, the ink supply system 2 illustrated is designed for only one color or one ink. In the case of an inkjet printer 1 for printing colored images, several ink supply systems 2 will be provided for at least the number of colors required.

The inkjet printer 1 has a horizontally disposed transport unit 3 for feeding an object to be printed 4 lying on it in a feed direction 5 (vertically out from the plane of the drawing based on this diagram) and retaining it to prevent it from slipping, for example. Disposed above the transport unit 3 is a print head arrangement 6 with print heads 7, by means of which the object 4 moved underneath will be printed with ink.

It should be pointed out that the ink supply system 2 illustrated may be used for single-pass printing systems in which the print heads are stationary. Accordingly, an object 4 to be printed can be printed across the entire, maximum printing width from end to end with the desired colors and, if desired, also with the color WHITE, a transparent color coating and/or a protective coating. The ink supply system 2 may naturally also be used for scan-print heads by means of which different colors may be applied by the various print heads, as well as optionally the color WHITE and/or transparent and/or protective coatings, but the print head or heads extend across only a part of the width of the object 4 to be printed and the color is applied in strips during a movement effected transversely to the longitudinal direction of the object 4 to be printed, and the object 4 to be printed is moved after every transverse movement of the print head across its width and the transport unit 3 is moved forwards intermittently in the feed direction by a pre-settable amount. It would also be possible to use the ink supply system 2 for printing systems in which the ink drops are deflected by an electromagnetic field on leaving the print head so that they hit the correct point of the object 4 to be printed, especially for applying fluids containing flux powders and/or pigments.

Especially if the liquids or pigments, usually inorganic pigments, have a higher specific weight than alcohol, for example, there is always a problem in that they settle or create sediment or agglomerate in the carrier fluids. This is especially the casing if used inorganic pigments containing titanium oxide, such as needed for the color white. The proposed solution has a particular advantage because the transport paths are short and the fluid containing the pigments or flux powder is constantly moving, enabling high quality processing with few disruptions.

The object 4 to be printed may be made from different materials, for example film-type materials of paper, plastic, metal, textile, wood and such like or non-woven materials, nets and such like or alternatively plate-shaped material and strip-shaped material made from the above-mentioned materials. In particular, it is possible to print board-type material or components or films of wood, for example including a wood structure different from this wood, ceramic such as ceramic components, either as fired goods or compacts, natural stone or other natural materials such as matting, nets, fleece or leather and other building material such as plaster board, plaster components or similar, for example.

The transport unit 3 is provided in the form of a circulating conveyor belt, which is fed and driven around at least two pulley blocks. The top portion of the conveyor belt moved in the feed direction 5 is supported at its bottom face by one or more guide plates, thereby resulting in a uniform horizontal movement of the object 4 in the feed direction 5. Instead of a conveyor belt, it would naturally also be possible to use a displaceable carriage on which the objects 4 to be printed are retained by means of a vacuum or clamping device or the objects 4 to be printed may be fed to the print head arrangement 6 on a roller track between guide rollers. The print head arrangement 6 based on this example of an embodiment has a plurality of print heads 7 for every color, in which case the entire width of the printing medium or object 4 can be printed at once without the print head arrangement 6 having to be moved sideways relative to the feed direction. In other words, the print head arrangement 6 is stationary in the sideways direction during printing and hence stationary with respect to the transport unit 3.

Each of the print heads 7 has a nozzle row comprising a plurality of adjacently lying and usually linearly oriented nozzles 8. In the case of print heads 7 of the type used as standard in so-called large-format printers, which usually operate on the basis of a piezoelectric ink ejection, the nozzle row contains 128 adjacently disposed nozzles 8 for example, although these are only schematically indicated by hatching in FIG. 1 in order to retain clarity. An individual print head 7 or a nozzle row therefore has a printing width 9 which extends perpendicular to the feed direction 5. The print heads 7 and their nozzle rows are arranged in a dense arrangement one alongside the other, thus constituting a total printing range width 10 of the print head arrangement 6. To enable the printing width 9 of the nozzle rows 8 to be aligned one alongside the other without any gaps, the print heads 7 must be disposed alternately offset from one another by reference to the feed direction 5, which is also illustrated in FIG. 1 by a slight vertical offset. Instead of being arranged vertically, the print heads 7 could also be disposed at an angle with respect to the feed direction 5, in which case a shorter printing width 9 will be obtained but a higher resolution or pixel density.

The ink supply system 2 firstly comprises a main tank 11, from which an intermediate tank 12 is supplied with ink. To this end, the latter are connected by a supply passage 13 in which a conveyor means 14 is disposed. In order to supply the print head 7 with ink from the intermediate tank 12, the latter is connected to the print head arrangement 6 or print heads 7 via a filling line 15. Accordingly, several print heads 7 are each connected via a separate line to the common intermediate tank 12. In this respect, it may be more practical for all the filling lines 15 connecting the intermediate tank 12 to the print heads 7 to be provided with a gradient directed from the intermediate tank 12 towards the print heads 7. The advantage of this is that air bubbles which can occur in the conveyed ink for various reasons are always able to escape upwards, thereby reducing many of the potential functional disruptions which might otherwise occur in a print head 7.

A conveyor means 16 is disposed in the filling line 15, by means of which the ink is conveyed out of the intermediate tank 12, through the filling line 15 to a supply tank 17 disposed between the latter and the print heads 7. In order to separate out any impurities, such as sedimentation or agglomerations in the ink, a filter arrangement 18 is disposed in the filling line 15 between the intermediate tank 12 and the supply tank 17. The supply tank 17 is connected respectively via a first connecting line 19 to the inlets of flow passages 20 in several print heads 7 connected in parallel. In one of the end regions of the flow passages 20 lying opposite one of the first connecting lines, the latter are each connected via a separate second connecting line 21 which connects the flow passage 20 to a return tank 22. Disposed in this return tank 22 is an intake line 23, which is connected to a return line 24 opening into the supply tank 17. In order to convey surplus ink from the return tank 22 to the supply tank 17, a conveyor means 25 such as a piston pump or vane pump is provided. Also disposed between the supply tank 17 and the intermediate tank 12 is a drainage line 26, which is preferably connected in the base region of the supply tank 17.

It is also of advantage if the first connecting lines between the supply tank 17 and the print heads 7 are connected in the base region of the supply tank 17.

It may be preferable to provide a conveyor means 27 in the drainage line 26, for example a pump. However, it would also be possible to activate the drainage line 26 via a valve arrangement 28 if necessary, where the line connection between the supply tank 17 and intermediate tank 12 is opened, whereas it is preferably closed during normal printing mode.

It would likewise be possible to provide valve arrangements 29 and 30 in the filling line 15 and in the return line 24. This being the case, these lines may also be opened and closed as necessary.

It is preferable if all the valve arrangements are fluid valves, which can preferably be adapted to the respective operating states via what are preferably electromechanical drives in response to control commands from a central control unit 31. These valve arrangements could naturally also be displaced manually, for example by emergency buttons or manual keys.

At least the return tank 22 but preferably also the supply tank 17 is at least alternately connected to a means 32, in particular a vacuum module, for controlling the counter-pressure at the print heads 7. Via this means, in particular a vacuum module which may be provided in the form of a vacuum generating system such as a vacuum pump or a Venturi nozzle arrangement for example, an appropriate counter-pressure to the hydrostatic pressure can be built up in the supply and/or return tank 17, 22 in the region of the nozzles 8 of the print heads 7.

To this end, at least the return tank 22 but preferably also the supply tank 17, is connected to the means or to the vacuum generating system via pressure connectors 33, 34. It is preferable to provide a central vacuum generating system or vacuum pump and the latter is alternately connected via the pressure connector to only the return tank 22 or only the supply tank 17, in which case a valve arrangement 35 is provided for this purpose which may be of the same design as the valve arrangement 28, 29 mentioned above. The means for controlling the counter-pressure also has active pressure control means 36. The latter are connected either directly or via the control unit 31 to sensor devices 37 and/or 38 and/or 39 in the return and/or supply and/or intermediate tank 22, 17, 12. They are primarily used to ascertain the filling levels in the individual tanks and may also be used to activate the conveyor means 16 and 25 via the control unit 31.

The means for maintaining a pressure difference, for example the vacuum system, is designed both to generate the pressure difference needed to circulate the ink and compensate for the drop in pressure caused by the hydrostatic pressure of the fluid column so that the absolute pressure of the fluid column in the region of the nozzle orifices 8 of the print heads is lower than the ambient air pressure. To this end, the supply and/or return tank 17, 22 is connected to the vacuum system so that air disposed above the liquid levels 40, 41 of ink can always be placed at a negative pressure relative to the ambient air pressure. This is necessary in order to prevent ink which has been conveyed to the nozzle orifice of the print head 7 from falling out due to the natural weight of the ink. Sensor devices 37, 38 are also provided in the supply and/or return tank 17, 22 to monitor the levels and are used to measure the liquid levels 40, 41 of the ink. With the aid of the sensor device or devices 37, 38, the liquid level 40, 41 in the tanks can be monitored by the control unit 31 and topped up from the intermediate tank 12 by activating the conveyor means 16 so that the liquid level 40, 41 is preferably kept constant.

Keeping the level of the liquid level at least more or less constant is important because the hydrostatic pressure of the ink corresponding to the level difference between the liquid level 40, 41 and the nozzle orifices of the nozzles 8 in the print heads 7 is partly responsible for the pressure conditions of the ink in the print heads 7 and thus for ensuring fault-free operation. In the stationary state when no ink is being ejected through the nozzles 8 of the print heads 7 and the ink merely is circulating in the circuit between the supply tank 17 and return tank 22, the sum of the air pressure prevailing above the liquid level in the tanks 17, 22 and the hydrostatic pressure of the ink fluid is exactly the same as or slightly lower than the ambient air pressure. In operating mode, when ink is being ejected through the nozzles 8 of the print heads 7 ink, the flow resistance caused by the ink flowing through the lines causes a pressure loss which reduces the fluid pressure of the ink in the print heads 7. The air pressure generated by the means above the liquid level 40, 41 in the tank or tanks 17, 22 must be adjusted so that the fluid pressure of the ink in the print heads 7 assumes a pressure tolerance range in every operating mode between stationary and maximum ink ejection required to guarantee fault-free operation of the print heads 7.

Generally speaking, the negative pressure or the air pressure prevailing above the liquid level 40, 41 must be set so as to create the pressure difference needed for the ink to flow on the one hand and to ensure that the correct meniscus negative pressure prevails at the nozzle orifice.

The method sequence which occurs during operation of the inkjet printer 1 will now be described below.

The ink in the intermediate tank 12 is sucked out of the intermediate tank 12 via a suction connector of a filling line 15 by a conveyor means 16, for example a conveyor pump, and is cleaned by a filter arrangement 18 disposed between the intermediate tank 12 and the conveyor means 16, for example, and if necessary any gas is also removed by means of a gas-removing unit 42, before passing through a valve arrangement 29 to the supply tank 17, which in this instance is open to permit a passage. The level 40 of the ink in the supply tank 17 is monitored by a sensor or a sensor arrangement 38. Via the means for controlling the pressure conditions in the supply tank 17 or in the return tank 22, a negative pressure is applied in the interior of the return tank 22 when the valve arrangement 35 is in the position illustrated in FIG. 1 so that the ink is forcibly fed via the first connecting lines 19, separately in each case, to the flow passages 20 in each of the print heads 7 connected in parallel, from where the ink is pressurized, for example by piezoelectric elements or any other pressure-generating means known from the prior art, so that an ink drop is ejected from a nozzle 8 of the print head 7, the ink being applied to the object 4 in a dotted arrangement.

Depending on how many ink drops are dispensed from a print head 7 in the unit of time, the ink flow is forced by the negative pressure prevailing in the return tank 22 through the second connecting lines 21 to the return tank 22. If a predefinable level 41 there is exceeded, the surplus ink is fed via the intake line 23 to the return line 24 and from there back into the supply tank 17, if necessary passing via an interconnected gas-removing unit 43.

In order to force the surplus ink to be fed out of the return tank 22, it would also be possible for a conveyor means 25, for example a pump, to be controlled by the central control unit 31 as a function of the level 41, which may be monitored by one or more sensor devices 37.

During the printing operation, the ink is prevented from circulating through the drainage line 26. This may be achieved by stopping the conveyor means 27 and/or by shutting off the line by means of the valve arrangement 28, as illustrated in FIG. 1 for example. In order to prevent and/or remove deposits caused by agglomerated particles, sedimentation, gelling or similar, it is now possible to reverse the ink flow in the connecting lines 19 and 21 in the described ink supply system 2 on an intermittent basis, i.e. on the basis of a pre-definable function or depending on the flow velocity of the ink and the quantity of ink consumed. This enables sediment and dirt to be kept in suspension, and any adhesion of deposits, especially resistant deposits, can be reduced merely by reversing the flow direction of the ink, advantageously including during an ongoing printing process. This reversal in the flow direction of the ink through the connecting lines 19 and 21 can be achieved by adjusting the valve arrangement 35 in the supply tank 17 to create a higher negative pressure than in the return tank 22, for example, so that the ink is forced to flow from the return tank 22 back into the supply tank 17.

Another operating mode may be initiated for example, whereby the time during which the flow direction of the ink is reversed so that it flows in the direction opposite the normal direction is kept relatively short, which prevents any overheating in the print heads 7 which might be caused by feeding in ink from the return tank 22 that is slightly warmer than that in the supply tank 17.

The fact that the ink circulates directly between the supply tank 17 and return tank 22 during normal operation offers an advantage in terms of printing in that if scanning print heads are used, i.e. of the type which are intermittently moved backwards and forwards transversely to the feed direction of the object 4 to be printed, the moved masses can be reduced by dispensing with a return line to the intermediate tank 12 which would have to be moved as well. In this situation, it may also be of advantage to provide a filter arrangement 18 or a gas-removing unit 43 in the return line 24 between the return tank 22 and supply tank 17.

The negative pressure conditions in the supply and return tanks 17, 22 as well as the various conveyor means 16, 25 may be controlled by the central control unit 31 on the basis of known commands. The means incorporating the active pressure control means 36 may also be controlled accordingly by the control unit 31 in order to create the pressure conditions in the supply and return tank 17, 22 and in the print heads 7, in particular in the outlet regions, described above. Instead of or in addition to controlling the pressure in the vacuum module, it would also be possible to provide pressure sensors 45 in the supply and/or return tank and/or in the flow passage.

Figure 2:
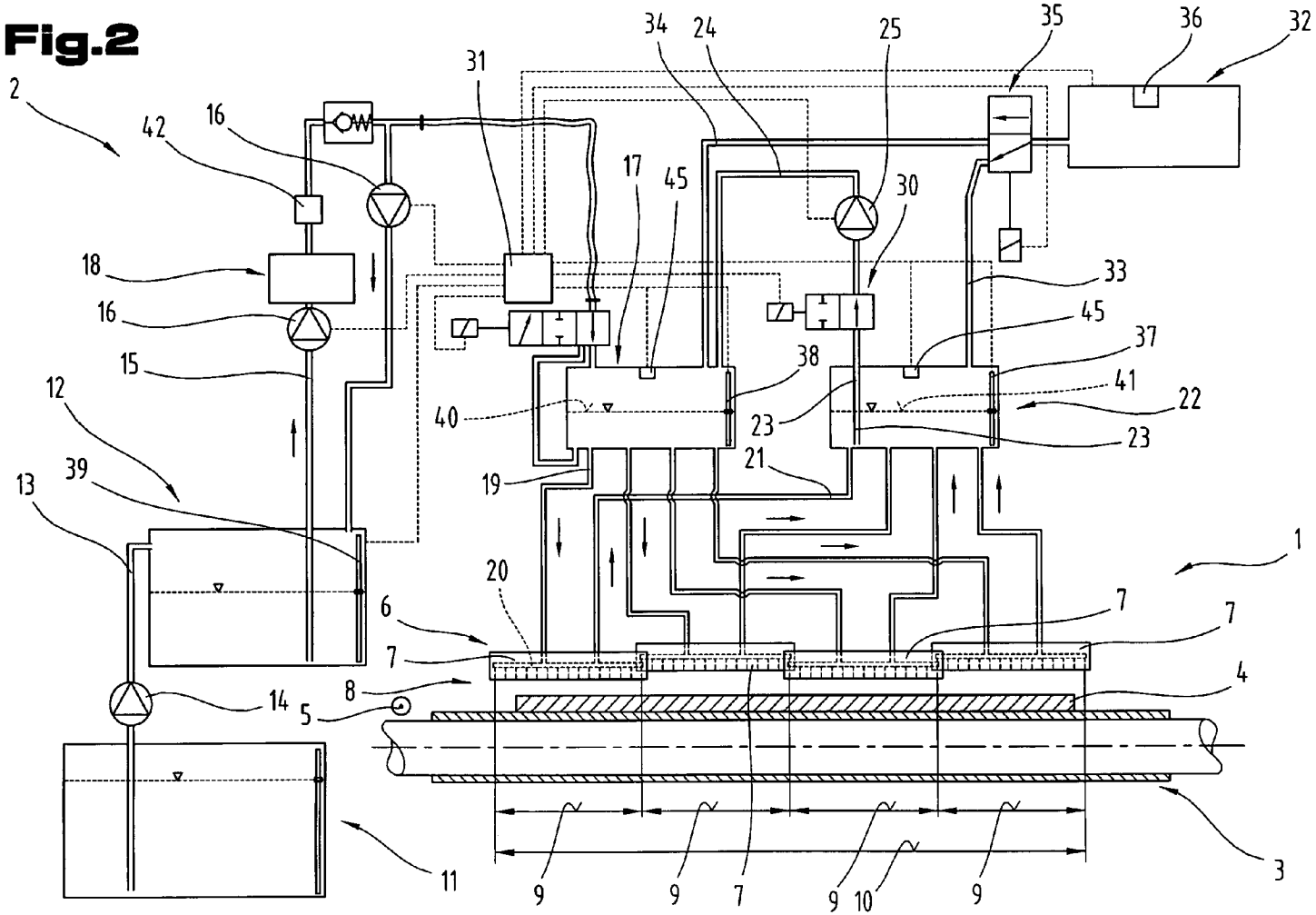
FIG. 2 is a highly simplified, schematic diagram of the ink supply system illustrated in FIG. 1 in the "cleaning" mode.

The diagram shown in FIG. 2 corresponds to the diagram shown in FIG. 1, and the same reference numbers are therefore used to denote the same parts.

FIG. 2 illustrates how the ink is forcibly conveyed from the return tank 22 to the supply tank 17 between the brief reversals in the ink circulation between the supply tank 17 and return tank 22 described above or alternatively how only a cleaning operation of the supply and return tanks 17 and 22 is run on the basis of a reversal caused by negative pressure.

This is achieved by the conveyor means 16 in the filling line 15 and once the valve arrangement 29 has been switched, its connection between the filling line 15 and return line 26 is operated in the conveying direction opposite that in which fresh ink is conveyed, in order to feed the contaminated ink—optionally bypassing the filter arrangement 18 and/or gas-removing unit 42 by means of a bypass line—back into the intermediate tank 12. Alternatively, it would naturally also be possible to provide a conveyor means 25 parallel with the conveyor means 16 in a separate line part in a line part parallel with the filling line 15 shut off by return valves. In this respect, it is preferable if the conveyor means 16, 25, filter arrangement 18 and gas-removing unit 42 are disposed on stationary parts of the inkjet printer 1—especially if the inkjet printer is fitted with scanning print heads 7—and the remaining part of the line part selectively serving as a filling line 15 or drainage line 26 is provided in the form of a highly flexible line so that the adverse effects of the line connection on the moved masses of the scanning print head 7 and the load on the scanning print head 7 caused by vibrations can be kept as low as possible or avoided altogether.

During normal printing mode, the negative pressure in the supply tank 17 is increased by switching the valve arrangement 35 to the position illustrated in FIG. 2 so that the ink is drawn out of the flow passages 20 of the individual print heads 7 to the connecting lines 19, 21 and the return tank 22. In this variant, only a single connecting line is provided between the supply tank 17 and intermediate tank 12, namely the filling line 15. For this reason, the valve arrangement 29 is of a special design whereby the position indicated by solid lines in FIG. 2 is a drainage line 26 which opens into the base region of the supply tank 17 and is connected to the filling line 15 so that the ink can be pumped by the conveyor means 16 from the supply tank 17, optionally bypassing the filter unit 18 and/or gas-removing unit 42 via a bypass line 47 which can be automatically activated and deactivated via return valves 48 in one direction or the other, and the contaminated ink can be pumped back into the intermediate container 12. The surplus ink which occurs in the supply tank 17 as a result can be sucked into the intermediate tank 12 by opening the valve arrangement 29 and/or pressurizing the conveyor means 16 to provide the conveying action into the intermediate tank 12. Any agglomeration of particles, sedimentation, gelling and similar occurring in the ink during the printing process due to physical/chemical reactions which become adhered to the connecting lines or to the tanks, can be easily detached by directing the flow opposite that prevailing during normal printing mode in order to convey them back to the supply tank 17 and intermediate tank 12.

Any deposits 47 or dirt which might be present in the flow passages 20 of the print heads 7 and would otherwise lead to unavoidable failure of the nozzles are removed.

The advantage of connecting the print heads 7 in parallel, especially connecting every individual print head 7 in parallel, between the supply and return tank 17, 22, is that the degree of contamination and disruption caused by contamination can be reduced to an even greater degree because the ink circulates through only a single flow passage 20 of a single print head 7.

In this operating mode with the valve arrangements 29 and 30 in the position illustrated in FIG. 2, fresh ink is prevented from circulating through the filling line 15 and ink is prevented from being fed out of the return tank 22 via the return line 24. The advantage of this is that any contamination is sucked out of the flow passages 20 due to the negative pressure in the supply tank 17, and blockages in the fine nozzle passages can be removed, which is easier and more gentle than applying a positive pressure.

This cleaning process or cleaning cycle can be improved if, having stopped the ink intake by the filling line 15 and the ink discharge through the return line 24 by generating an appropriate negative pressure in the return tank 22, the entire ink supply is sucked out of the supply tank 17 via the base region and can be circulated though the print heads 7, and can even be so at a higher flow rate if necessary. Once the supply tank 17 has been emptied, the negative pressure can then be applied exclusively to the supply tank 17 via the means, for example by switching the valve arrangement 35, or a higher pressure can be applied to the return tank 22 than that prevailing in the supply tank 17.

As a result, the ink is sucked out from the base region of the return tank 22 and through the connecting lines 19, 21 and flow passages 20 of the print heads 7 as far as the supply tank 17, and from there can be fed via the filling line 15 and drainage line 26 to the intermediate tank 12 when the valve arrangement 29 is in the appropriate position indicated by solid lines.

The contamination which occurs during these cleaning processes does not prevent the ink from being reused because it is mixed with the ink supply in the intermediate tank 12 and optionally with the fresh ink fed in from the main tank 11, and the ink is then fed from the intermediate tank 12 through the filter arrangement 18, where this contamination is finally removed and fed out of the ink circuit.

The advantage of this approach in the case of so-called scanning print heads is that only a single, preferably elastic connecting line—the section of the filling line 15 between the valve arrangement 6 and the conveyor means 16 or filter arrangement 18—is needed between the intermediate tank 12 and the recycling or return tank 17, 22, thereby improving the unimpaired movement of the scanning print head. Furthermore, the moved masses in the scanning print head are less complicated due to the fact that the ink is circulated directly between the supply and return tanks. By intermittently reversing the conveying direction between the supply and return tanks 17, 22, any contamination which exists is held in suspension and the process of fully pumping out the ink, rinsing the print heads, disposing of the ink pumped back into the intermediate tank for the cleaning operation and cleaning it via the filter arrangement 18 need only be run at longer intervals, which means that the printing device is available for longer, i.e. output per unit of time can be significantly improved.

The ink supply system described above also requires a heating and temperature control system for the ink. To this end, it is possible to pre-heat or heat the ink in the main tank 11 already. Electrical heating elements 51 may be provided in the main tank for this purpose, as well as temperature sensors 52. The heating elements 51 are controlled by running a monitoring operation with the temperature sensors 52 via the control unit 31.

The main point, however, is that the ink in the intermediate tank 12 is exactly regulated and controlled by means of heating elements 51 based on the temperatures measured by the temperature sensors 52 and the ink is maintained at the temperature needed at the print heads 7. Another option would be to go slightly above this temperature so that the ink can be delivered to the supply tank 17 or print heads 7 at the desired temperature even if slight cooling occurs in the transport lines from the intermediate tank 12 to the print heads 7.

In one particularly advantageous embodiment, the ink supply system proposed by the invention is provided with two heating stages and, in addition to the first heating stage, namely the heating elements 51 in the intermediate tank 12, a heating element 51 is also provided in the supply tank 17, and the temperature in this supply tank 17 is exactly monitored by means of temperature sensors 52. The heating elements 53 may be operated at a lower power than the heating elements 51 in the intermediate tank 12 and it is therefore possible to control the temperature within a range of +/−0.2° C. to a very high degree of accuracy if appropriate temperature sensors are used.

As with the intermediate tank 12, control may be assumed by means of the control unit 31.

These two heating stages ensure that the temperature of the ink at the print heads 7 can be maintained in an extremely precise manner. This is particularly important in terms of obtaining high quality printing results because the temperature has a major effect on viscosity and hence the formation of drops when the inks are ejected onto the print heads 7.

However, it would also be possible to provide heating elements 51 or 53 in the return tank 22, for example. These heating elements in the return tank 22 may be used to heat the ink to a higher temperature during the cleaning process so that a low viscosity is obtained. This improves the flow properties of the ink during the cleaning process and keeps any contamination in suspension or detaches sedimentation and agglomerations. In this connection, it would also be possible to raise the temperature of the ink briefly by means of the heating elements 53 prior to starting the cleaning process, especially if the ink is initially pumped from the supply tank 17 into the return tank 22, in order to take advantage of this lower viscosity of the ink during the operation of rinsing the print heads 7 in the direction of the return tank 22.

The embodiments illustrated as examples represent possible variants of the ink supply system 2, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the structure of the ink supply system and the inkjet printer, they and their constituent parts are illustrated to a certain extent out of scale and/or on an enlarged scale and/or on a reduced scale.

Figure 3:
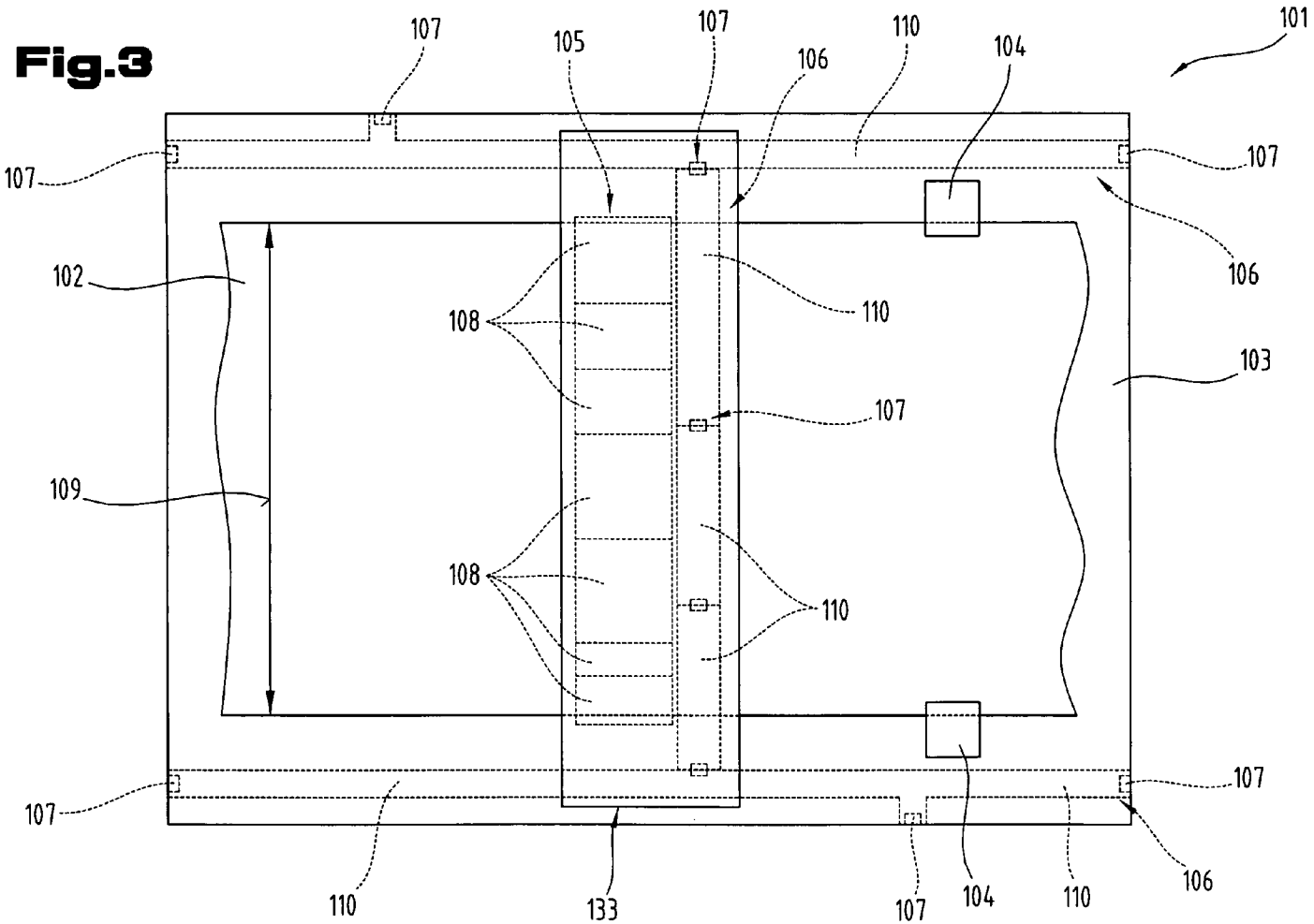
FIG. 3 is a highly simplified, schematic diagram showing a plan view of the inkjet printer proposed by the invention with a printing device.

FIG. 3 is a schematic diagram illustrating the inkjet printer 101 proposed by the invention. A medium 102 to be printed lies on an essentially flat support surface of a printing table 103, to which part of a medium positioning device comprising several table modules can be releasably connected by means of identically arranged and designed coupling mechanisms to form the printing table (103). The medium 102 to be printed is fed by a medium transport device 104 past a print head arrangement 105 so that a predefined image is applied to the surface of the printing medium 102 by selectively activating specific individual printing nozzles of the print head arrangement 105. The print head arrangement 105 is supplied with process media, in particular ink, as well as electrical power and image data via the connecting line system 106. Disposed in the outer peripheral regions of the printing table module 103 in defined positions are coupling mechanisms 107, which may be provided in the form of several push-fit coupling elements. It is of advantage if the coupling elements have identically disposed and/or matching line connectors, in which case they may act as complementary coupling parts so that a coupling can be established by push-fitting the coupling elements directly, and in addition to providing line connections for transmitting signal and image data, fully automatic couplings are also provided for any fluids or gases which might have to be pressurized. The connecting line system 106 may be coupled with other modules by means of these coupling mechanisms 107.

The print head arrangement 105 comprises a plurality of print head modules 108, disposed so that the printing nozzles of the print heads of the print head modules 108 together constitute a printing range width 109. The print head modules 108 may be of an identical design in terms of print resolution and the process media which can be printed, although print head modules 108 of different designs may also be distributed across the printing range width 109. For example, a print head arrangement may be set up so that portions of the printing range width are printed with printed areas of low resolution, whereas in other portions, the print head module may be set up so that high-resolution graphics or text can be printed. Print head modules with a high resolution are much more expensive than print head modules with a lower resolution, both to produce and maintain, and it is therefore of particular advantage to use a high print resolution only where finely structured images have to be printed.

Figure 4:
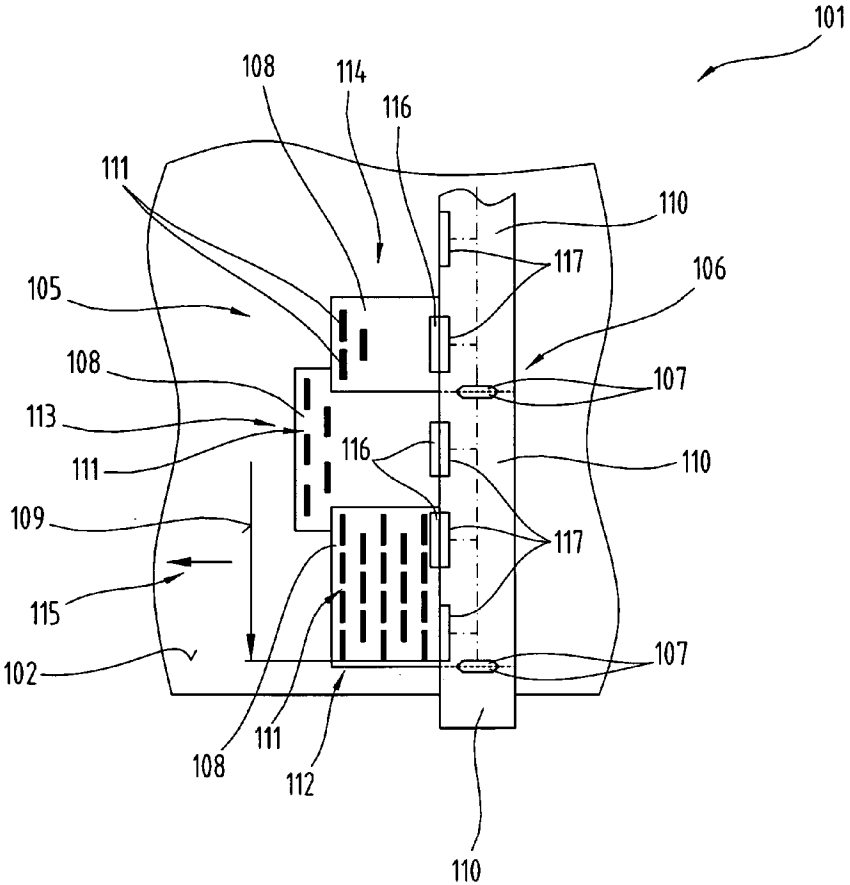
FIG. 4 is a schematic diagram showing a plan view of the print head arrangement illustrated in FIG. 3 with a plurality of print heads.

Each of the print head modules 108 is connected to the connecting line system 106 by means of a coupling mechanism 116 illustrated in FIG. 4. The connecting line system comprises a plurality of connecting line modules 110, which are connected to one another by coupling mechanisms 107. Each of these connecting line modules 110 comprises a plurality of connecting lines which are grouped into a connecting line string and all the coupling mechanisms 107 as well as any output or input modules which might be provided are connected to one another. Due to the modular design, the connecting line system can be extended to virtually any size. In particular, this approach ensures that, irrespective of the specific disposition of the print head modules 108 of the print head arrangement 105, every print head module is safely and reliable supplied with process media, electrical power and printing data, without having to adapt the connecting line system or the connecting line modules.

Due to the fact that the printing table 103 has a plurality of coupling mechanisms 107, the connecting line system can be extended outside the printing table module 103 more or less freely and universally because the coupling mechanisms 107 are totally identical and designed to the same rating.

FIG. 4 is a schematic diagram providing a detailed illustration of the inkjet printer 101 proposed by the invention. The print head arrangement 105 comprises a plurality of differently designed print head modules 108, and in particular the print head modules have differently designed or disposed print heads 108. The print heads 111 of the print head modules 108 are disposed so that the portions to be printed adjoin or slightly overlap one another, thereby constituting the total printing range width 109. The first print head module 112 is a three-color printing module for example, in which case a full colored image can be produced by this print head module in one work step. Every print head row of this print head module prints one of the three basic colors (YMC), for example. The second print head module 113 may be designed to produce high-resolution monochrome print, whilst the third print head module 114 is designed to produce a color-printed surface.

The printing medium 102 is moved in the feed direction 115 underneath the print head arrangement 105 and the nozzles of the print heads 111 are activated accordingly, so that the predefined image is transferred onto the surface of the printing medium 102. The printing medium may be fed continuously, for example, or may be conveyed in steps.

Each print head module 108 has at least one coupling mechanism 116 by means of which the print head module is supplied with process media, electrical power and image control data. The coupling mechanism 116 is connected to the print head coupling mechanism 117 of the connecting line module 110 and is therefore also connected to the connecting line system 106. By means of this connecting line system 106, every print head module 108 is connected to the process medium processing system, in particular to the respective co-operating ink tanks, the electrical power supply and the data processing unit for processing the image data, and the individual supply and processing units need not necessarily be disposed in the immediate vicinity of the printing table module.

The connecting line modules 110 are connected to one another by coupling mechanisms 107 and can therefore be extended in any way to form a bigger range for the printing range width to be covered. Every print head module 110 of the print head arrangement 105 has a print head coupling mechanism 117 in fixedly predefined positions, to which a print head module 108 can be connected by means of the coupling mechanism 116. The print head coupling mechanism is designed so that when a connector is not being used or is out of operation, the interfaces are shut off in a fluid-tight and gas-tight arrangement. Due to the modular design, the print head arrangement can be adapted to the desired printing range width by adding print head modules. In particular, the print head arrangement can be readily extended or adapted at any time to suit different requirements in terms of the printed image. For example, the connecting line modules may also be designed so that they also assume the function of a mechanical support, thereby dispensing with the need for other devices for bridging the printing range width. The print head modules are coupled with the connecting line system, in particular the connecting line modules, and can therefore be mechanically secured by them above the printing medium, and if the coupling mechanism is based on a mating-type design, the correct distance can be automatically set between the printing nozzle outlet orifice and the surface of the printing medium, thereby obviating the need for complex adjustments. Another advantage of this modular design, especially in terms of producing a complete inkjet printer, is that a plurality of different designs and structures can be obtained, especially as regards the process media and printing range width, and it is also possible to adapt to the respective medium to be printed without the need for complex redevelopment or structural changes, which represents a quite considerable cost advantage.

Figure 5:
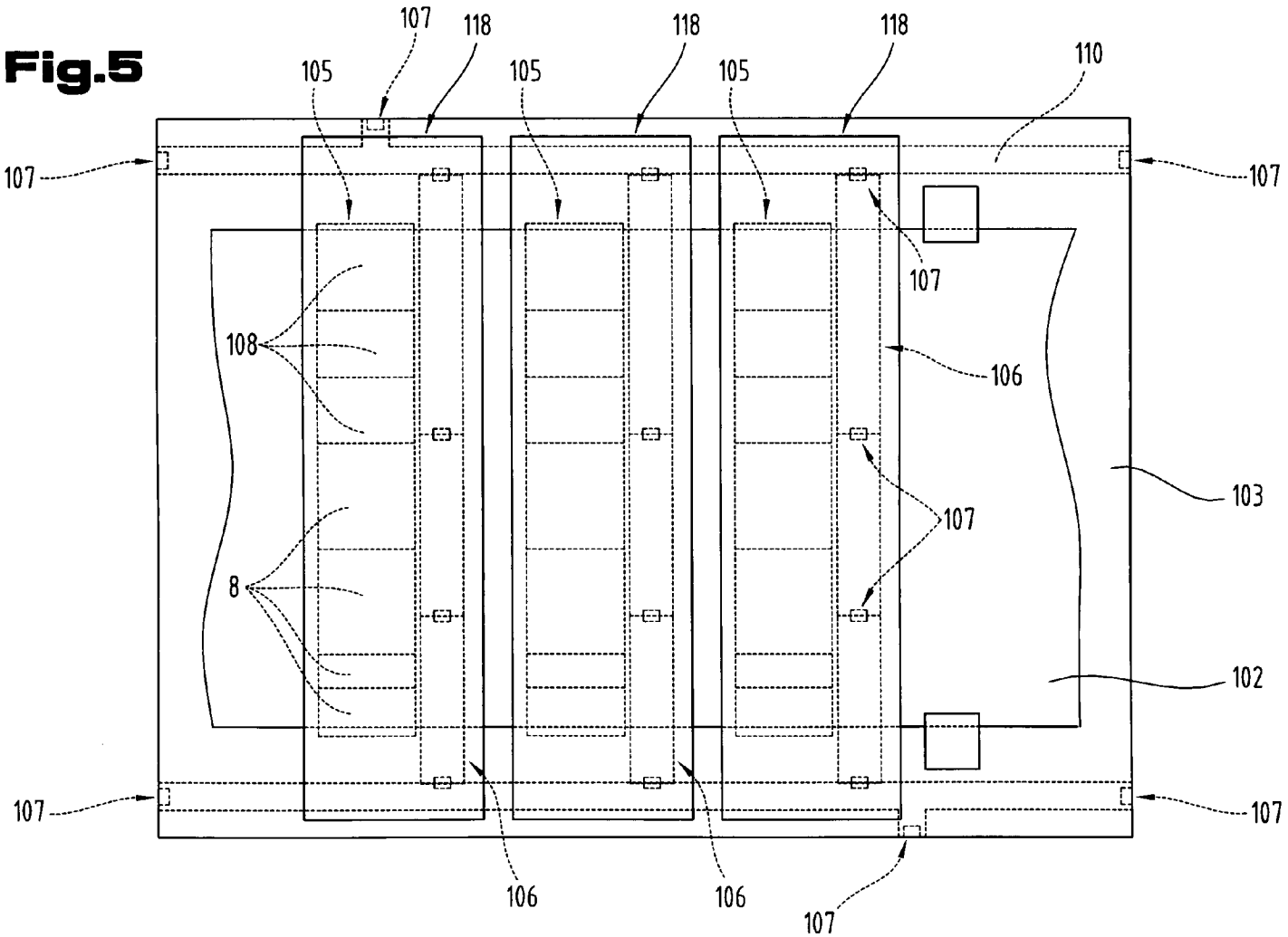
FIG. 5 is a schematic diagram showing a plan view of the inkjet printer proposed by the invention with three printing devices.

FIG. 5 illustrates another possible embodiment of the inkjet printer 101 proposed by the invention. In the case of this embodiment, three printing devices 118 are provided, disposed one after the other relative to the feed direction. Each printing device carries a color extract of the printed image onto the printing medium 103. However, this arrangement is not limited to applying three different colors and in particular, it is possible for a printing device to apply a base coat, for example an agent to impart adhesion, whilst the second printing device applies the printed image to the printing medium and the third printing device coats the printed image with a fixing medium, for example.

Due to the modular design, in particular due to the modular design of the connecting line system, the number of print head arrangements which may be provided and their specific design is virtually unlimited.

Figure 6:
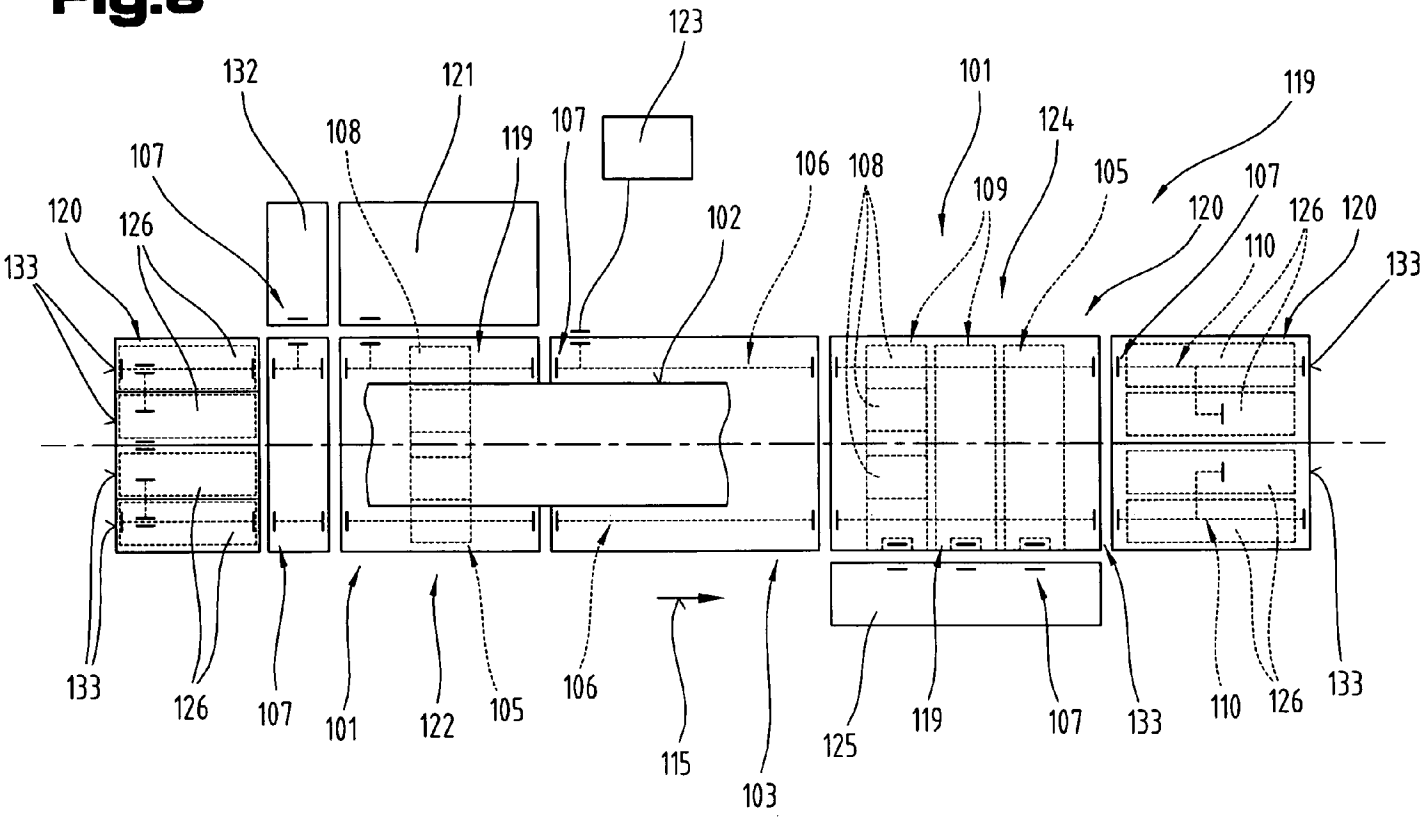
FIG. 6 is a highly simplified, schematic diagram of a modular inkjet printer with the modular medium positioning device.

FIG. 6 illustrates an inkjet printer 119 based on a modular design. The connecting line system 106 extends through the individual modules equipped with one or more coupling mechanisms 107 and ensures that the modules, and in particular the print head arrangements 105, are reliably supplied with process media, electrical power and printing data. Since every coupling mechanism 107 comprises a plurality of coupling mechanisms 107, it is therefore possible to supply process media, electrical power and printing data to essentially every line connection of a coupling mechanism 107 of each and every module. In particular, this design results in an extremely flexible arrangement of the individual modules, which enables the printing range width to be changed easily and quickly.

A medium conveying module 120 assumes the function of feeding the printing medium to the inkjet printer 119. This medium conveying module 120 may be provided in the form of a conveyor such as conveyor belts, conveyor lines, chain conveyors, roller conveyors or similar, designed to handle flat components such as ceramic tiles and in particular board materials. However, it would also be conceivable to opt for a reel system for an endless medium, such as paper or film supplied on a roll.

A power supply module 132 is connected via the coupling mechanism 107 to the connecting line system 106 and thus supplies all the print head modules 108 and/or table modules 133 and medium transport modules 126, which for reasons of clarity are only schematically illustrated in FIG. 6 of the drawings, namely in the region of the two outer medium conveying modules 120.

As illustrated in FIG. 6 in the case of the medium conveying module 120 shown on the outer right-hand side of the drawing in the feed direction 115, table modules 133 may be provided, each of which accommodates the respective 2 medium transport module 126, and the two mutually connected table modules 133 accommodating the 4 medium transport modules 126 can each be connected via separate connecting line modules 110 to coupling mechanisms or correspondingly designed coupling mechanisms 107 to other table modules 133 of the adjacent medium conveying modules 120. The individual medium transport modules 126 may also be connected to the connecting line modules 110 via appropriate coupling mechanisms 107.

In the case of the medium conveying module 120 accommodating the print head arrangements 105, it is also possible to provide only one table module 133 for the plurality of adjacently disposed medium transport modules 126—although this is not illustrated in the embodiment shown as an example.

As illustrated in the case of the medium transport module 120 shown on the outer left-hand side in the feed direction 115, it is also possible to provide a separate table module 133 for each of the medium transport modules 126.

These individual medium transport modules 126 and table modules 133 can be connected by means of coupling mechanisms 116 of the type described in detail above or by appropriately designed coupling mechanisms 107 which enable the individual modules 100, 126 to be positioned exactly relative to one another and secured.

The essential thing is that the modular design of the medium conveying modules 120 means that a large number of identical modules can be manufactured on a mass production basis and the medium conveying modules 120 needed for different applications and which are simultaneously able to accommodate and support the print head arrangements 105 can be assembled from these individual modules. It is also possible to provide medium transport modules 126 of different types on identical table modules 200 but these are provided with identically disposed and designed coupling mechanisms 116. For example, the medium transport modules 126 may be provided with circulating belt drives, air conveying systems, vacuum fixing mechanisms or roller conveyors.

This makes it easier to store spare parts and replace faulty modules, thereby ensuring that the inkjet printer is up and running for longer.

The power supply module 132 supplies the inkjet printer 119 with electrical power. A process medium processing system module 121 is connected to the connecting line system 106, likewise via a line connector, and therefore supplies all the print head arrangements with process media, in particular with different inks.

However, the requisite process media may also be fed on a decentralized basis from several modules into the connecting line system, for example if it is necessary for technical reasons to feed in a process medium as close to the processing print head arrangement as possible.

FIG. 6 illustrates a first print portion 122 with a print head arrangement 105. This print head arrangement 109 might be used to apply a base coat to the printing medium, for example. For example, it is necessary to apply a white base coat to the printing medium in order to produce so-called white print, before printing in color. To ensure that this coating has sufficient time to dry, it may be preferable for the first print portion 122 to be spaced at a distance apart from another print portion. All the base coats that are needed can be applied in the first print portion so that the image subsequently applied will reliably adhere to the surface of the printing medium.

The image to be printed usually exists in electronic format and is processed by a data processing unit 123 so that every print nozzle of each and every print head module is activated accordingly at the right time and thus ejects an ink drop. With a knowledge of the characteristics of the individual print head modules as well as their position in the print head arrangement relative to the printing range width, the data processing unit 123 can split the image to be printed into packets for the individual print head modules and forward them to the individual print head modules via the connecting line system 106.

The second print portion 124 comprises three print head arrangements 105, for example, disposed one after the other, each applying a process medium to the printing medium, in particular a different ink. For this print portion, the process medium processing system 125 is connected directly to the print head arrangements and there is no need for a distribution via the distribution system 106 in the case of this embodiment. Connected downstream of the second print portion is a medium transport module 126, which picks up the printed printing medium and/or prepares the ongoing processing. This might involve a drying run with a downstream winding device, and in the case of printed ceramic plate material the module may also have a support device for a drying or firing oven.

This diagram illustrates an example of one possible arrangement of different modules of the inkjet printer 119. Due to the modular design, in particular the universal connection options of the connecting line system 106, there are no limits to the complexity of the inkjet printer which can be configured. In particular, a plurality of differently designed print portions can be connected one after the other without the need for complex arrangements to supply the individual portions with process media, power and control data. This is a major advantage, especially if an existing inkjet printer has to be modified or extended. In a different arrangement of the print head modules, the characteristic features of the print head arrangement are picked up by the data processing unit and processing of the printing data is adapted accordingly. For example, the printing range width can be obtained simply by changing the number of print head modules and connecting line modules 110.

Figure 7:
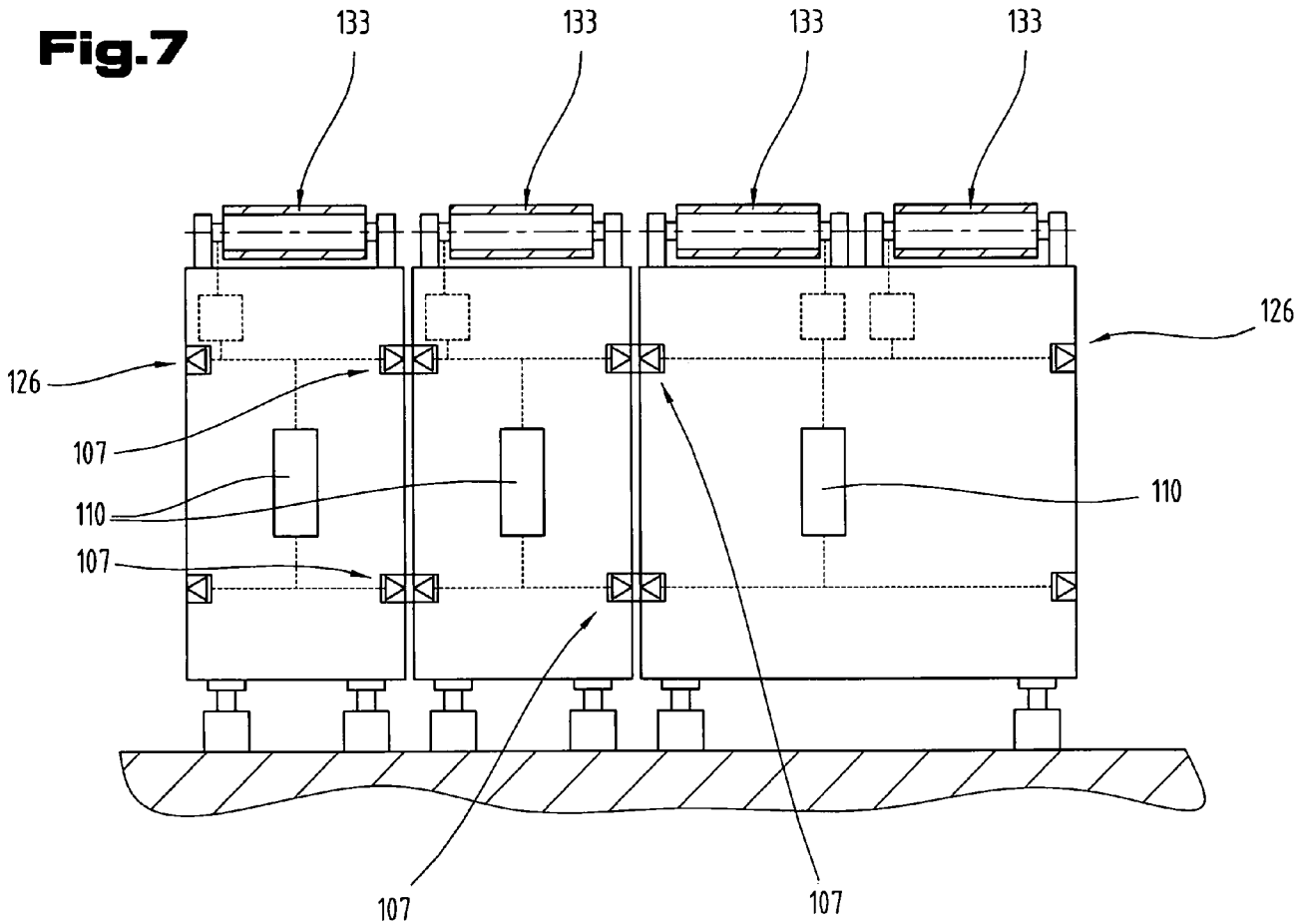
FIG. 7 is a highly simplified, schematic diagram showing a head-on view in partial section of a modular medium transport device.

FIG. 7 schematically illustrates a front view of a different arrangement and design of individual table modules 133 and the medium transport modules 126 co-operating with them.

The individual table modules 133 may also be of a modular design based on prefabricated parts with rapid connecting elements which can be connected to the co-operating table constructions in a mating arrangement, to which the standardized medium transport modules 126 for different types of drives can be attached by a mating system and easily connected to the control and supply lines via the connecting line modules 110.

Figure 8:
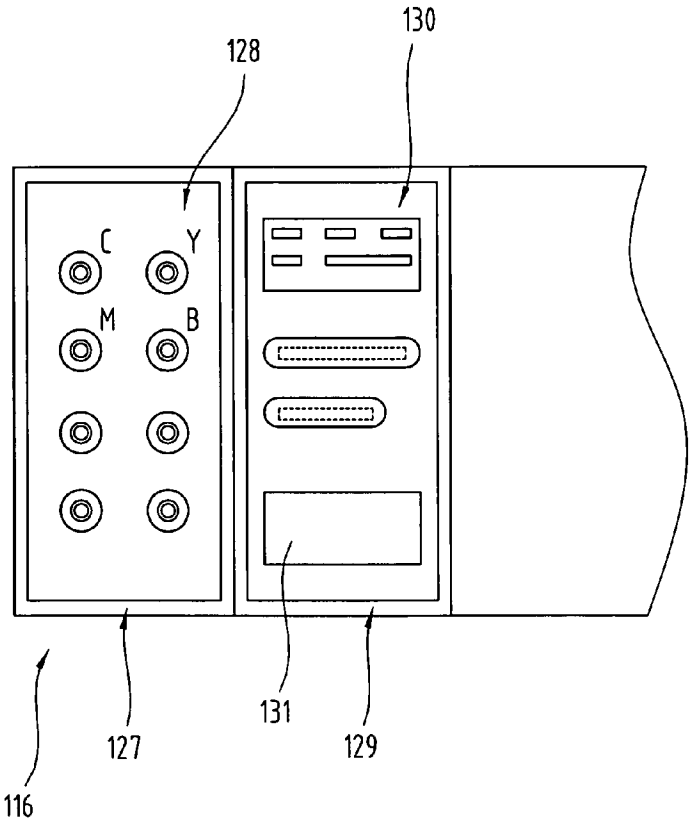
FIG. 8 is a schematic diagram showing an exemplary design of the coupling mechanism.

FIG. 8 is a detailed view illustrating an example of the coupling mechanism 116 respectively 107. In one coupling element 127, interfaces 128 are provided as a means of grouping the process media supply, for example. All the interfaces 130 belonging to the group comprising electrical power supply or for supplying printing data as well as status reporting are disposed in another coupling element 129. The advantage of this grouped arrangement in portions is that additional features can be provided in every portion to ensure a reliable contact or protect against access. For example, structural features might ensure that the process medium interfaces are not connected until the electrical contacts have been established, thereby preventing any unintentional release of process medium through the printing nozzles.

An identification feature 131 is also incorporated in the coupling element 129, for example. This identification feature can preferably be read without contact and contains characteristic data about the respective print head module. For example, information about the possible print resolution as well as the process media which can be handled is memorized. When the print head modules are connected to the connecting line module, the identification feature is read and the characteristic data is transmitted to the data processing unit, which is made aware of the specific design of the print head arrangement as a result and can prepare the image data to be printed so that it is adapted to the technical options of the print head module. The identification feature may be provided in the form of an optically readable code, for example a barcode, although it would also be conceivable to use an RFID feature. Of particular advantage is a design whereby the identification feature is able to transmit status signals to the data processing unit during operation.

The objective underlying the independent inventive solutions may be found in the description.

Above all, the individual embodiments of the subject matter illustrated in FIGS. 1 to 8 constitute independent solutions proposed by the invention in their own right. The objectives and associated solutions proposed by the invention may be found in the detailed descriptions of these drawings.

LIST OF REFERENCE NUMBERS

| | |
|---|---|
| 1 | Inkjet printer |
| 2 | Ink supply system |
| 3 | Transport unit |
| 4 | Object |
| 5 | Feed direction |
| 6 | Print head arrangement |
| 7 | Print head |
| 8 | Nozzles |
| 9 | Printing width |
| 10 | Printing range width |
| 11 | Main tank |
| 12 | Intermediate tank |
| 13 | Supply passage |
| 14 | Conveyor means |
| 15 | Filling line |
| 16 | Conveyor means |
| 17 | Supply tank |
| 18 | Filter arrangement |
| 19 | First connecting line |
| 20 | Flow passage |
| 21 | Second connecting line |
| 22 | Return tank |
| 23 | Intake line |
| 24 | Return line |
| 25 | Conveyor means |
| 26 | Drainage line |
| 27 | Conveyor means |
| 28 | Valve arrangement |
| 29 | Valve arrangement |
| 30 | Valve arrangement |
| 31 | Control unit |
| 32 | Means |
| 33 | Pressure connector |
| 34 | Pressure connector |
| 35 | Valve arrangement |
| 36 | Active pressure control means |
| 37 | Sensor device |
| 38 | Sensor device |
| 39 | Sensor device |
| 40 | Liquid level |
| 41 | Liquid level |
| 42 | Gas-removing unit |
| 43 | Gas-removing unit |
| 44 | Circulation line |
| 45 | Pressure sensor |
| 46 | Conveyor means |
| 47 | Flow direction |
| 48 | Internal wall |
| 49 | Flow direction |
| 50 | Heating elements |
| 51 | Temperature sensor |
| 52 | Heating element |
| 101 | Inkjet printer |
| 102 | Printing medium |
| 103 | Printing table module |
| 104 | Medium transport device |
| 105 | Print head arrangement |

-continued

| | |
|---|---|
| 133 | Table module |
| 106 | Connecting line system |
| 107 | Coupling mechanism |
| 108 | Print head module |
| 109 | Printing range width |
| 110 | Connecting line module |
| 111 | Printing nozzles |
| 112 | First print head module |
| 113 | Second print head module |
| 114 | Third print head module |
| 115 | Feed direction |
| 116 | Coupling mechanism |
| 117 | Print head coupling mechanism |
| 118 | Printing device |
| 119 | Inkjet printer |
| 120 | Medium conveying module |
| 121 | Process medium processing system |
| 122 | First print portion |
| 123 | Data processing unit |
| 124 | Second print portion |
| 125 | Process medium processing system |
| 126 | Medium transport module |
| 127 | Coupling element |
| 128 | Interfaces |
| 129 | Coupling element |
| 130 | Interfaces |
| 131 | Identification feature |
| 132 | Power supply system |

1 Inkjet printer 26 Drainage line 2 Ink supply system 27 Conveyor means 3 Transport unit 28 Valve arrangement 4 Object 29 Valve arrangement 5 Feed direction 30 Valve arrangement 6 Print head arrangement 31 Control unit 7 Print head 32 Means 8 Nozzles 33 Pressure connector 9 Printing width 34 Pressure connector 10 Printing range width 35 Valve arrangement 11 Main tank 36 Active pressure control means 12 Intermediate tank 37 Sensor device 13 Supply passage 38 Sensor device 14 Conveyor means 39 Sensor device 15 Filling line 40 Liquid level 16 Conveyor means 41 Liquid level 17 Supply tank 42 Gas-removing unit 18 Filter arrangement 43 Gas-removing unit 19 First connecting line 44 Circulation line 20 Flow passage 45 Pressure sensor 21 Second connecting line 46 Conveyor means 22 Return tank 47 Flow direction 23 Intake line 48 Internal wall 24 Return line 49 Flow direction 25 Conveyor means 50 Heating elements 51 Temperature sensor 126 Medium transport module 52 Heating element 127 Coupling element 128 Interfaces 101 Inkjet printer 129 Coupling element 102 Printing medium 130 Interfaces 103 Printing table module 104 Medium transport device 131 Identification feature 105 Print head arrangement 132 Power supply system 133 Table module 106 Connecting line system 107 Coupling mechanism 108 Print head module 109 Printing range width 110 Connecting line module 111 Printing nozzles 112 First print head module 113 Second print head module 114 Third print head module 115 Feed direction 116 Coupling mechanism 117 Print head coupling mechanism 118 Printing device 119 Inkjet printer 120 Medium conveying module 121 Process medium processing system 122 First print portion 123 Data processing unit 124 Second print portion 125 Process medium processing system

The invention claimed is:

1. An ink supply system for an inkjet printer comprising a print head arrangement incorporating several print heads with one or more nozzles for at least one color, which print heads are connected via first connecting lines to a supply tank connected to an intermediate tank via a filling line with a first interconnected conveyor device and filter arrangement, wherein each print head is connected via a respective second connecting line to a common return tank, and with a pressure control device connected to the return tank for maintaining a pressure difference between the pressure in the supply tank and the pressure in the return tank to control a flow of ink from the supply tank via the flow passages of the print heads connected in parallel to the return tank, wherein the return tank is connected to the supply tank via a return line, wherein the pressure difference between the pressure in the return tank and the pressure in the supply tank is intermittently varied by the pressure control device so that the pressure difference controls an ink flow from the return tank to the supply tank through the print head and such that the flow direction of the ink through the at least one print head is reversed to achieve cleaning.

2. The ink supply system according to claim 1, wherein the supply tank is connected via a filling line to an intermediate tank connected via a supply passage to a main tank, and the conveyor device and a filter arrangement and a gas removing unit are disposed in the filling line.

3. The ink supply system according to claim 1, wherein the supply tank is connected to the intermediate tank via an activatable drainage line.

4. The ink supply system according to claim 1, wherein at least a part of the filling line can be activated as part of the drainage line via a valve arrangement.

5. The ink supply system according to claim 1, wherein a second conveyor device is disposed in the drainage line.

6. The ink supply system according to claim 1, wherein the pressure control device comprises sensor devices for detecting a liquid level in at least one of the supply tank and the return tank.

7. The ink supply system according to claim 6, wherein the pressure control device comprises a level maintainer which maintains a difference in height between the liquid level and a nozzle orifice of each print head in at least one of the supply tank and the return tank.

8. The ink supply system according to claim 1, wherein the pressure control device compensates for a drop in pressure caused by hydrostatic pressure of liquid levels in the supply tank and the return tank so that an absolute pressure of a liquid column the near nozzle orifices of the print heads is lower than ambient air pressure.

9. The ink supply system according to claim 1, wherein the second connecting line opens into a base region of the return tank.

10. The ink supply system according to claim 1, wherein the drainage line between the supply tank and the intermediate tank opens into a base region of the supply tank.

11. The ink supply system according to claim 10, wherein the first connecting line between the supply tank and print head opens into the base region of the supply tank.

12. The ink supply system according to claim 1, wherein a valve arrangement is disposed between the pressure difference in pressure control device and the supply tank and the return tank for selectively connecting the pressure control device to the supply tank or the return tank.

13. A method of operating an ink supply system for an inkjet printer comprising a print head arrangement incorporating several print heads with one or more nozzles for at least one color, which print heads are connected via first connecting lines to a supply tank connected to an intermediate tank via a filling line with a first interconnected conveyor device and filter arrangement, wherein each print head is connected via a respective second connecting line to a common return tank, and with a pressure control device connected to the return tank for maintaining a pressure difference between the pressure in the supply tank and the pressure in the return tank to control a flow of ink from the supply tank via the flow passages of the print heads connected in parallel to the return tank, wherein the return tank is connected to the supply tank via a return line, wherein the pressure difference between the pressure in the return tank and the pressure in the supply tank is intermittently varied by the pressure control device so that the pressure difference controls an ink flow from the return tank to the supply tank through the print head and such that the flow direction of the ink through the at least one print head is reversed to achieve cleaning, said method comprising:

feeding the ink from a supply tank to each of the print heads separately via respective separate first connecting lines in printing mode and circulating the ink from the print heads respectively via separate second connecting lines to a return tank and back to the supply tank again, wherein during printing mode, the ink is fed directly from the return tank to the supply tank and an amount of the ink in the supply tank is maintained via the filling line during printing operation.

14. The method according to claim 13, wherein a valve arrangement is disposed between the pressure control device and the supply tank and the return tank for selectively connecting the pressure control device to the supply tank or the return tank and wherein during printing mode, the flow direction of the ink between the supply tank, print heads and return tank back to the supply tank is at least intermittently reversed via the valve system for a pre-definable period.

15. The method according to claim 14, further comprising emptying via negative pressure all of the ink from the supply tank and the return tank into the intermediate tank during or at the end of cleaning.

16. The method according to claim 15, further comprising directing the ink from the return tank through the print head into the supply tank and from the supply tank into the intermediate tank whilst the print head is being cleaned.

17. The method according to claim 14, further comprising feeding the ink from the intermediate tank to at least one of the supply tank and the return tank and using the filling line to drain the ink from at least one of the supply tank and the return tank as well as the print heads.

18. The method according to claim 13, wherein the flow direction of the ink between the supply tank and the return tank is intermittently varied for a pre-definable period.

19. The method according to claim 13, further comprising feeding all of the ink from the supply tank through the print head into the return tank, after which the direction in which the ink is conveyed is reversed and all the ink is drained from the return tank, connecting lines, print head and supply tank into the intermediate tank.

20. The method according to claim 13, wherein a negative pressure is built up in the supply tank in order to suck the ink out of the return tank via the print head into the supply tank.

21. The method according to claim 13, wherein the ink is pumped from the supply tank or the return tank into the intermediate tank via a second conveyor device.

22. The method according to claim 13, wherein a vacuum is generated on an alternating basis in the return tank or the supply tank or in the interior of the return tank or the supply tank during the cleaning process in order to transport the ink from the supply tank into the return tank and from the return tank into the supply tank via the print head.

23. The method according to claim 13, wherein the ink fed from the intermediate tank to the supply tank is filtered and fresh ink from a main tank is added to the ink returned to the intermediate tank during printing mode or during cleaning.

24. The method according to claim 23, further comprising causing the first interconnected conveyor device and filter arrangement to halt adding fresh ink to the supply tank and filling the supply tank with ink drained from the return tank and subsequently draining the supply tank.

25. The method according to claim 13, further comprising reversing the flow direction of the ink in the connecting lines and in the ink supply system at least intermittently and at least once during a cleaning process such that ink flows from the return tank to the supply tank through each of the print heads.

* * * * *

UNITED STATES PATENT AND TRADEMARK OFFICE

CERTIFICATE OF CORRECTION

PATENT NO. : 8,408,685 B2
APPLICATION NO. : 12/590007
DATED : April 2, 2013
INVENTOR(S) : Delueg It is certified that error appears in the above-identified patent and that said Letters Patent is hereby corrected as shown below:

In the Claims:

Column 22, line 39, Claim 8 after the word "column" please delete: "the". (first occurrence)

Column 22, lines 51-52, Claim 12 after the word "the" please delete: "pressure difference in".

Signed and Sealed this
Third Day of September, 2013

Teresa Stanek Rea
*Acting Director of the United States Patent and Trademark Office*